United States Patent [19]

Strauser

[11] 4,176,697

[45] Dec. 4, 1979

[54] MACHINE FOR MAKING WOODEN BEE BOX COMPONENTS

[76] Inventor: John W. Strauser, P.O. Box 991, Walla Walla, Wash. 99362

[21] Appl. No.: 859,811

[22] Filed: Dec. 12, 1977

[51] Int. Cl.[2] ..... B27C 1/08; B27C 5/00; B27C 3/04

[52] U.S. Cl. ..... 144/7; 83/162; 83/425.2; 83/449; 144/3 R; 144/92; 144/135; 144/136 R; 144/245 R; 144/253 R; 144/326 R

[58] Field of Search ..... 144/1 R, 2 R, 3 R, 7, 144/135, 35 R, 39, 41, 117 R, 134 R, 134 A, 136 R, 326 R, 312, 245 R, 253 R, 253 C, 92, 133; 83/422, 425, 425.2, 162, 448, 449

[56] References Cited

U.S. PATENT DOCUMENTS

| | | | |
|---|---|---|---|
| 157,473 | 12/1874 | Hutchins | 144/312 X |
| 462,797 | 11/1891 | Hazard | 83/425.2 |
| 629,167 | 7/1899 | Mondeng | 144/7 |
| 655,938 | 8/1900 | Mondeng | 144/7 |
| 3,897,811 | 8/1975 | Nelson | 144/136 R X |
| 3,934,630 | 1/1976 | Cockle | 144/3 R X |

*Primary Examiner*—Robert Louis Spruill

*Assistant Examiner*—W. D. Bray

*Attorney, Agent, or Firm*—Wells, St. John & Roberts

[57] ABSTRACT

An automatic machine for forming bee box components from wooden stock members by grouping the members in a single row and indexing them past several work stations at which the members are formed into the box components. The row of engaged members pass by the first cutting station where end grooves are cut in opposite ends of the individual members as they pass by. Guide bars then are received within the grooves and support the members as they are moved along to a second cutting station. At this station, angularly oriented milling heads form grooves along the longitudinal side edges of the stock members. The row is moved along in increments by an indexing mechanism that receives successive individual stock members from a feed mechanism. The indexing mechanism also includes a drilling assembly that functions to form longitudinally spaced holes through the members as they are received and indexed forwardly. Thus, the members enter the machine as rectangular blanks and leave a discharge end of the machine finished bee box components.

6 Claims, 7 Drawing Figures

MACHINE FOR MAKING WOODEN BEE BOX COMPONENTS

BACKGROUND OF THE INVENTION

The present invention relates to the field of apparatus for manufacturing bee keeping components and more particularly to such apparatus utilized to automatically produce the end components of foundation frames for bee boxes. The end components or bars are subcomponents of a frame that is ordinarily placed in a box or "super". The end bars are utilized to hold a wax or plastic sheet of "foundation" upon which the bees build their home for storage of honey, pollen, or a combination of these. The end bars are usually produced in differing lengths but all generally have grooves that extend approximately half the length of the members' outside edges. These grooves, when the frames are assembled together, define passages through which the bees can travel from one frame to another. Further, the typical end bar includes a number of holes through which wires are passed to mount the foundation. The opposite ends of the members are notched or "dadoed" to receive and mount the top and bottom bars of the frame.

DESCRIPTION OF A PREFERRED EMBODIMENT

Figure 4:
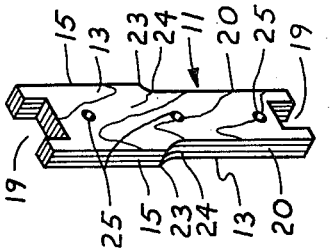
FIG. 4 is a view similar to FIG. 3 only showing the side grooves and the completed bee box component.

The machine of the present invention is generally designated in the drawings by the reference character 10. The machine 10 is utilized for producing bee box components of which a single component is shown in FIG. 4 at 11. The individual components are formed from wooden stock members such as shown at 12 in FIG. 1. For the purpose of later description, dimensions of the members will be given as follows: each member includes opposite face surfaces 13 that are spaced apart a first distance 14 that defines the thickness of the member; each member 12 also includes opposed longitudinal side edge surfaces 15 that are spaced apart by a second distance 16 that defines the width of the member; and each member 12 also includes end edge surfaces 17 that are spaced apart by a third distance 18 that defines the length of the member.

Figure 1:
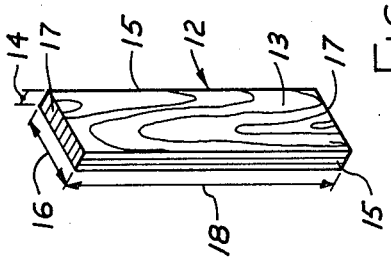
FIG. 1 is an isometric view of a single wooden stock member.

The machine 10 automatically operates to mill the member illustrated in FIG. 1 to the configuration shown in FIG. 4. In doing so, end grooves 19 are formed in the end surfaces 17 and side grooves 20 are formed in the opposed side edge surfaces 15. The side grooves 20 are formed from points 23 at the approximate longitudinal center of the members. The grooves 20 start in a curvature 24 that lead into the member and toward one of its ends. Also included with each of the finished components 11 is a number of longitudinally spaced holes 25 formed through its thickness.

The present machine 10 accomplishes the reformation of the individual stock members 12 at several successive work stations. These stations are located along a central supportive framework 26. The wood stock members 12 enter the machine via a feed means 27. Feed means 27 delivers the stock members to an infeed station 28 and orients them with their face surfaces 13 substantially transverse to an intended direction of travel. This direction is indicated by the directional arrow 29 in FIGS. 5 and 6.

An indexing means 30 is associated with the feed means 27 to incremently move the successive stock members 12 in the intended direction of travel. The indexing means 30 functions to shift successive members 12 along the direction of travel from the infeed station 28 along the intended direction of travel by a distance 32 that is equal to or preferably slightly greater than the distance 14.

The indexing means 30 forms a solid row of the stock members in which the face surfaces of one member directly engage a face surface of the next successive member. This row of members is formed adjacent the infeed station 28 and extends the full length of the machine to its discharge end 33 where the members may be removed for further processing.

A drilling means 31 is associated with indexing means 30 for the purpose of drilling the holes 25. Drilling means 25 operates at the infeed station 28 to drill the holes in each successive member 12 before it is moved with the remainder of the row to the next station.

As the row of members is indexed in increments along the intended direction of travel, the successive members come into contact with a first milling means 34. Milling means 34 is located at a first cutting station 35 that is downstream of the indexing means in relation to the intended direction of travel. The first milling means 34 functions to form the end grooves 19 as the successive members pass by.

Groove guide bars 36 are positioned on the frame 26 adjacent the first cutting station 35 for receiving the successive stock members 12 and guiding them toward a second milling means 37. The guide bars 36 are complementary in configuration to the end grooves 19 and support as well as guide the individual members 12 along the intended direction of travel.

The side grooves 20 are formed by the second milling means 37 at a second cutting station 38. The grooves 20 are formed in the opposite side edge surfaces 15 while the members 12 are supported at their side grooves 20 by the groove guide bars 36.

After completion of the formation of side grooves 20, the members 12 are indexed on toward the discharge 33.

The above generalized description was given to provide an overall understanding of the machine and its components in relation to the formation of the bee box components 11. A more detailed description of the device may now be understood.

Figure 2:
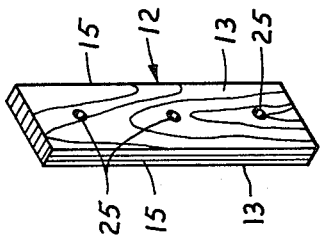
FIG. 2 is a view of a stock member similar to that shown in FIG. 1 only including longitudinally spaced holes.

The feed means as shown in FIG. 1 and fragmented in FIG. 2, is formed of a simple upright magazine 45. The magazine 45 receives individual stock members 12 along an inclined guide surface 46. Surface 46 allows the members 12 to slide gravitationally to upright guide members 47. The guide members 47 are aligned substantially transverse to the intended direction of motion so as to orient the stock members 12 with their face surfaces 13 also oriented in the transverse relation. As shown in FIG. 1, an upright stack of the members 12 are formed between the upright guide rods 47. The rods lead to the infeed station 28 at which the bottom member 12 of the stack rests against the framework 26. The member 12 in this position is set for engagement with the indexing means 30.

Figure 5:
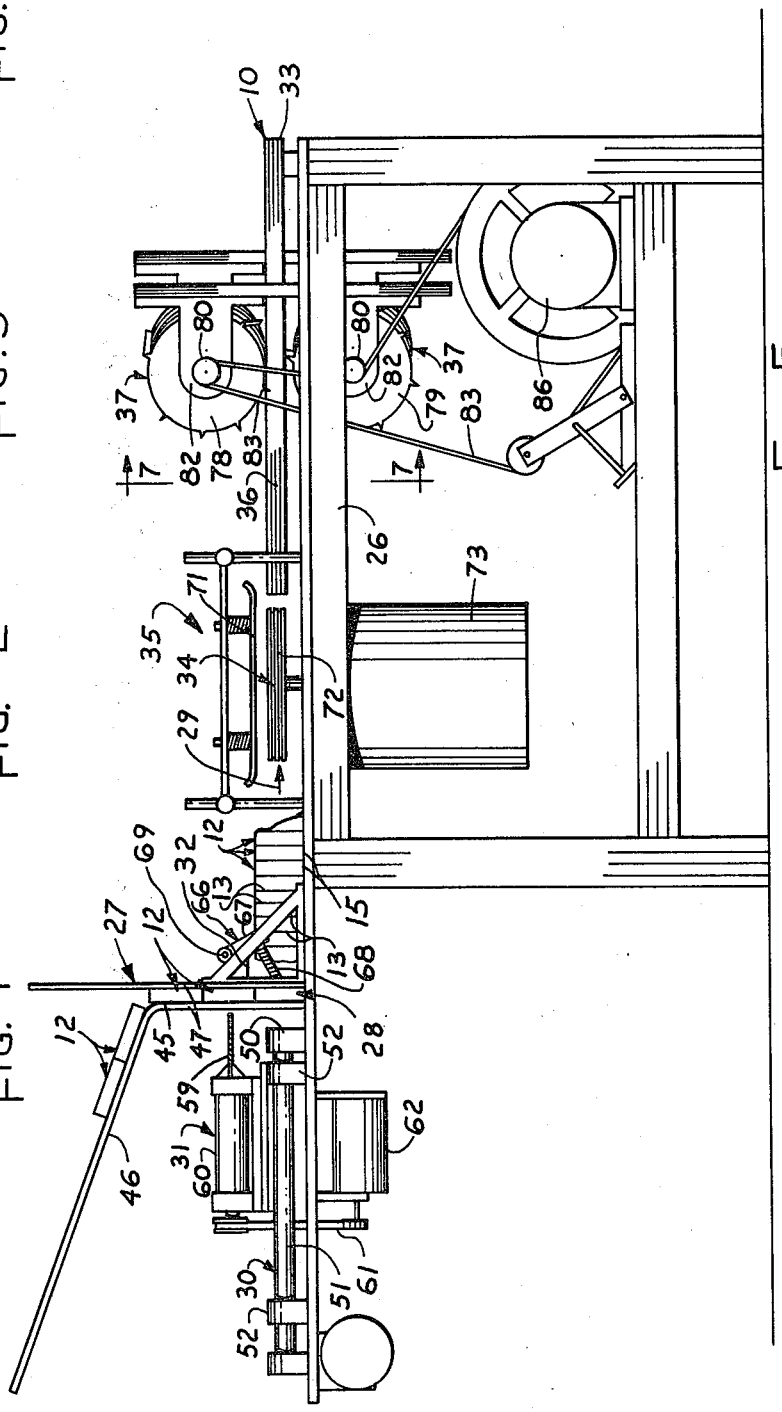
FIG. 5 is an elevational view of the present machine.
Figure 6:
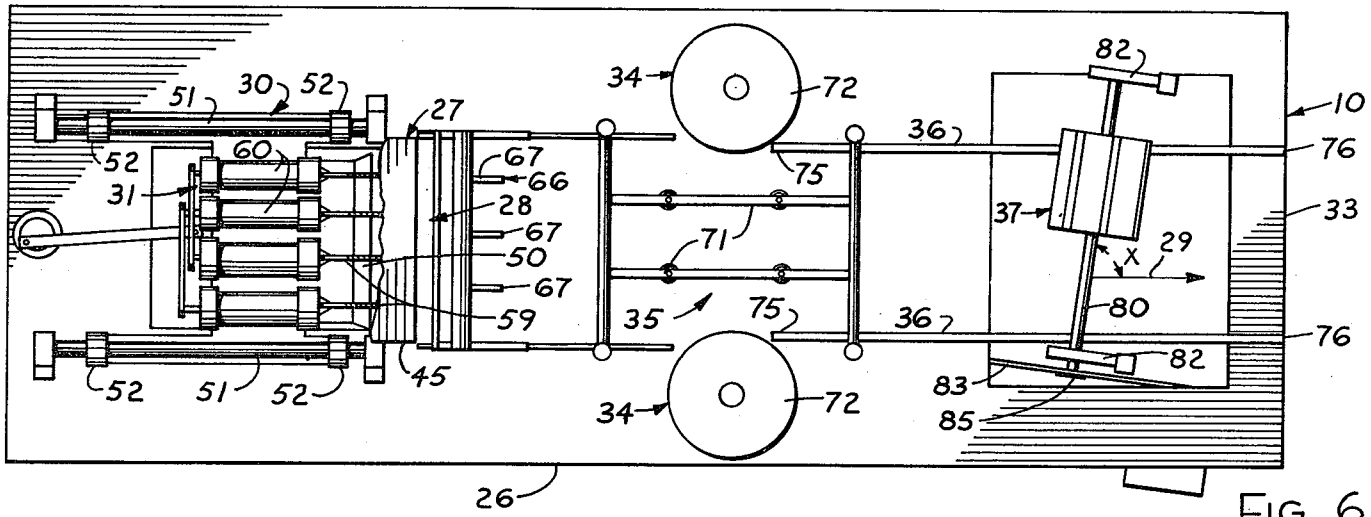
FIG. 6 is a plan view of the machine.

Indexing means 30 includes a transverse pusher bar 50. Guide rods 51 slidably mount the pusher bar 50 for reciprocating movement along the intended direction of travel past infeed station 28. The pusher bar 50 engages successive members 12 and pushes them the distance 32 as shown in FIG. 5. In doing so, the pusher bar also pushes the previously positioned members of the row along the intended direction of motion. The guide rods 51 are slidably held by sleeves 52 on the framework 26. Rods 51 and pusher bar 50 are reciprocated by a drive means 53. The drive means 53 includes a connecting rod 54 extending between the pusher bar and an eccentric 55. A drive motor 56 is provided to rotate the eccentric 55 and thereby produce the reciprocating motion.

The drill means 31 is associated with the indexing means 30 to automatically drill the longitudinally spaced holes 25 in each member. Drill means 31 includes a number of drills 59 that are releasably held within chucks 60. The drills 59 are rotated simultaneously by a common drive linkage 61. A single motor 62 is supplied to operate through drive 61 to rotate drills 59. This complete assembly (drills 59, drive linkage 61, and motor 62) is mounted to the pusher bar 50 and guide rods 51 for reciprocating movement therewith. Thus, as the pusher bar 50 is moved forwardly, so are the drills 59. They will engage a member 12 held between the upright guide rods 47 and drill the holes simultaneously as the pusher bar 50 moves the member immediately below over the indexing distance 32.

The drills 59 function to support the stack of members as the bottom member is pushed into the row. They will then retract with the pusher bar and allow the drilled member to drop onto the frame at infeed station 28.

Slightly downstream of the infeed station 28 is a stop means 66. The stop means 66 is comprised of a number of pivoted feet 67 that are retained by a spring 68 to pivot toward the infeed station 28. The members 12 that are being indexed in the intended direction of travel past the feet 67 will be engaged by their toothed lower surfaces. If there is a rearward force caused by "kickback" from the cutting stations downstream, the feet 67 will bind at their pivots 69 to prevent rearward movement of the members in the row.

The indexing means 30 forms the row of members 12 along frame 26 and urges them in the intended direction of travel toward the first milling means 34. Prior to arrival at milling means 34, the members 12 come into contact with a pair of hold down guides 71. These guides prevent elevational movement of the members as they pass through the first cutting station 35.

A laterally spaced pair of cutting heads 72 are provided at the first cutting station 35. The heads 72 are rotated counter to the intended direction of travel by motors 73. The cutting heads 72 may be conventional forms of "dado" heads for producing the end grooves 19 as the row is incrementally moved through the first cutting station 35.

Figure 3:
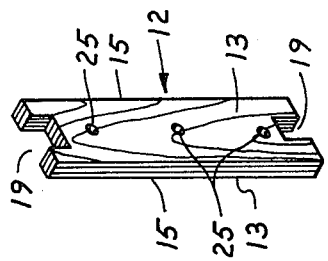
FIG. 3 is a view similar to FIG. 2 only showing grooves cut in opposite ends of the member.

The result of movement of a single member 12 past the cutting station 35 is the formation of end grooves 19 and the configuration shown in FIG. 3. It is important, in the sequence of operations, that the end grooves 19 be formed prior to the operation of the second milling means 37.

The end grooves 19 receive the groove guide bars 36. Guide bars 36 are mounted to the framework with forward ends 75 closely adjacent to the cutting heads 72. The guide bars 36 extend horizontally along the intended direction of travel to ends 76 at the discharge 40. The end grooves 19 which are complementary in cross section to the end grooves 19 but of slightly smaller dimension will receive and slide over the bar surfaces. From the moment the guide bars 36 engage the end grooves 19, no other support is provided for the members 12. The end support provided by bars 36 allows for operation of the second milling means 37.

Figure 7:
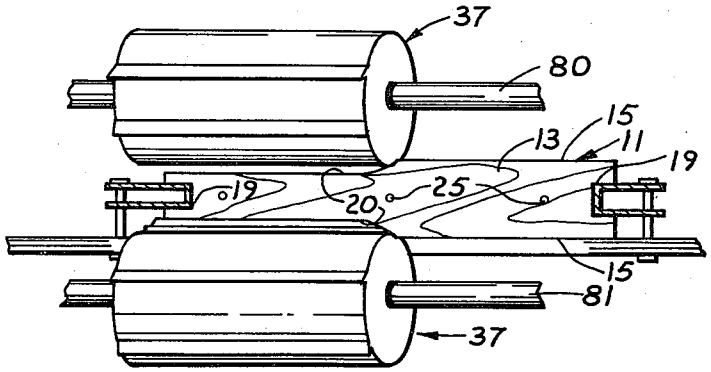
FIG. 7 is a fragmentary sectional view taken along line 7—7 in FIG. 5.

The second milling means 37 is comprised of at least one cutting head situated in the path of the forwardly moving row to form at least one side groove 20. Specifically, it is preferred that there be provided an upper cutting head 78 and a lower head 79. These cutting heads 78 and 79 are mounted for rotation on shafts 80 and 81 respectively for milling both side grooves 20 (FIG. 7).

Bearings 82 mount the shafts 80 and 81 to the framework 26. It should be noted that the shafts 80 and 81 are parallel to one another and that they are set at an acute angle X with respect to the intended direction of travel for the members 12. In so orienting the cutting heads, I am able to form the side grooves 20 with the curvatures 24 leading from central points 23. This step in the formation of the components 11 is shown in detail in FIG. 7.

The shafts 80 and 81 are both connected to a single belt or chain 83 through interconnecting pulleys or sprockets 85. A motor 86 drives the belt or chain 83 to rotate cutting heads 78 and 79 in clockwise directions.

As each member 12 passes through the second cutting station 38, the cutting heads 78 and 79 first engage the member adjacent its central points 23. These points 23 are located at the approximate longitudinal center of the successive members and are the first points of engagement due to the angular orientation of the cutting heads 78 and 79. As the member is indexed forwardly in the intended direction of travel and held elevationally stationary by the guide bars 36, the curved surface 24 is formed and the remainder of the side grooves 20 take shape.

With the arrangement of machine components as I have described above, the finished bee box components may be produced at a rate of at least 20,000 pieces over an 8 hour shift. The machine develops a high degree of accuracy because it does not require the use of feed chains or rollers. In addition, as a safety measure, an operator may be protected from the cutting heads by appropriate shrouds (not shown) and, coupled with the anti-kickback feature of the stop means 66, provides a relatively safe operating machine. In addition, the components may be adjusted to accommodate members 12 of different dimensions.

The above description was given to present a preferred form of the invention and was not intended to place any restrictions upon the scope thereof. Only the following claims are to be taken as limitations upon the scope of my invention.

What I claim is:

1. An automatic woodworking machine for forming bee box components from elongated wooden stock members, each stock member including: (a) face surfaces spaced apart a first distance defining the thickness dimension of the member; (b) side edge surfaces spaced apart by a second distance defining the width of the member; (c) end edge surfaces spaced apart by a third distance defining the length of the member; said machine comprising:

feed means for positioning the wooden stock members with their facing surfaces upright and transverse to an intended direction of movement and for delivering successive members oriented in this condition to an infeed station;

indexing means cooperating with the feed means for receiving successive stock members from the feed means at the infeed station and for incremently moving them in the intended direction of travel in a row with the face surface of one stock member engaging a face surface of the immediately preceding stock member;

drill means operated in conjunction with the indexing means for drilling holes through each stock member from one face surface to the other;

first milling means at a first cutting station for milling end grooves in the end edge surfaces between face surfaces as the members progressively move past the first station;

spaced, elongated, end groove guide bars complementary to the dimensions of the end grooves and extending past a second cutting station for riding in the end grooves to guide and support the members by their ends as the members are progressively moved forward past the second station; and second milling means at the second cutting station for milling a side groove in at least one of the side edge surfaces of each member as the member is moved past the second cutting station supported at its end by the groove guide bars.

2. The automatic woodworking machine as defined in claim 1 wherein said second milling means includes a cutting head rotatably mounted on a shaft in which the axis of the shaft is set at an acute angle with respect to the direction of travel of the stock members.

3. The automatic woodworking machine as defined by claim 1 wherein the second milling means is comprised of at least one cutting head driven to rotate about an axis set at an acute angle with respect to the direction of travel of the stock members for initially engaging each stock member at a point approximately midway between its end edge surfaces and subsequently cutting the groove from that point to one of the end surfaces.

4. The automatic woodworking machine as defined by claim 1 wherein the drill means is mounted on the indexing means and is operating simultaneously with the indexing means for drilling holes through successive stock members from one face surface to another and for holding the members in the feed means as a stock member is indexed forwardly by the indexing means and for subsequently releasing the members held by the feed means.

5. The automatic woodworking machine as defined by claim 1 wherein the feed means includes an upright magazine having upright guide bars for directing an upright stack of stock members to the indexing means.

6. The automatic woodworking machine as defined by claim 1 wherein the indexing means is comprised of a pushbar mounted for reciprocating motion along the intended direction of movement, and drive means for reciprocating the pushbar in successive strokes of equal length, said stroke length being at least equal to the thickness dimension of the stock members;

stop means adjacent the pushbar for receiving successive stock members and holding them from backward movement with respect to the intended direction of travel but allowing forward movement in the intended direction of travel.

* * * * *